US006541719B1

(12) United States Patent
Powell

(10) Patent No.: US 6,541,719 B1
(45) Date of Patent: Apr. 1, 2003

(54) CIRCUIT BREAKER COUPLER FOR OPPOSITELY DISPOSED CIRCUIT BREAKERS

(75) Inventor: William Powell, Simsbury, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 09/789,911

(22) Filed: Feb. 21, 2001

(51) Int. Cl.[7] ..... H01H 9/20
(52) U.S. Cl. ..... 200/50.32; 200/50.33
(58) Field of Search ..... 200/50.01, 50.32–50.37, 200/50.4, 17 R, 18, 335, 337; 335/8, 9, 10

(56) References Cited

U.S. PATENT DOCUMENTS

| | | | | |
|---|---|---|---|---|
| 3,158,701 A | * | 11/1964 | Nadeau | 200/50 |
| 3,706,916 A | | 12/1972 | Halbeck et al. | 361/102 |
| 3,789,169 A | * | 1/1974 | Yazvac | 200/50 C |
| 4,510,357 A | * | 4/1985 | Winterbottom | 200/50 R |
| 4,644,114 A | * | 2/1987 | Strobel | 200/50 C |
| 4,760,226 A | | 7/1988 | Fasano | 200/303 |
| 5,109,142 A | * | 4/1992 | Von Kannewurff et al. | 200/50 R |
| 5,373,411 A | | 12/1994 | Grass et al. | 361/64 |
| 5,614,878 A | | 3/1997 | Patrick et al. | 335/14 |
| 5,648,646 A | * | 7/1997 | Flegel | 200/50.32 |
| 5,719,738 A | | 2/1998 | Singer et al. | 361/196 |
| 5,838,219 A | * | 11/1998 | Du et al. | 335/14 |
| 6,031,193 A | * | 2/2000 | Flegel | 200/50.33 |

OTHER PUBLICATIONS

Carlingswitch Product Bulletin, No. 81, Mar. 31, 2000 "Circuit Product Bulletin".

* cited by examiner

*Primary Examiner*—Michael Friedhofer
*Assistant Examiner*—Lisa N Klaus
(74) *Attorney, Agent, or Firm*—McCormick, Paulding & Huber LLP

(57) ABSTRACT

A circuit breaker assembly is comprised of a first circuit breaker and an oppositely oriented circuit breaker adjacent thereto. The circuit breaker toggle actuators are coupled to one another by an offset coupler or tie such that when one circuit breaker is ON, the other is OFF and vice versa. A motorized circuit breaker module is preferably provided alongside one of the breakers or poles to allow remote operation thereof.

6 Claims, 4 Drawing Sheets

CIRCUIT BREAKER COUPLER FOR OPPOSITELY DISPOSED CIRCUIT BREAKERS

FIELD OF THE INVENTION

The present invention relates to a coupler for oppositely disposed circuit breakers, such that when one circuit breaker is switched ON, the other is automatically switched OFF.

BACKGROUND OF THE INVENTION

Circuit breaker couplers that automatically switch one circuit breaker OFF when another is switched ON are typically used in applications where different sources of power, e.g., utility power and emergency generator power, are to be alternatively connected to a load and where it is critical that both not be connected to the load simultaneously. There are many other applications, both residential and commercial, in energy management, diagnostics and smart appliances, for example, where coupled circuit breakers are considered to be advantageous.

Manually operated coupled circuit breakers so arranged that one turns ON when the other turns OFF, are known in the prior art. U.S. Pat. No. 5,648,646 for CIRCUIT BREAKER LINKAGE ASSEMBLY, for example, discloses an interlock for tandemly aligned first and second circuit breaker switches, which respectively have first and second external operating handles oriented such that the operating handles are disposed oppositely from each other so that with one of the switches OFF, the other switch is ON. The interlock of the '646 patent includes a linkage arrangement formed with at least one slot. The linkage has one end connected to the first operating handle and another end connected to the second operating handle such that pushing the first operating handle from an OFF to an ON position pushes the second operating handle from an ON to an OFF position.

U.S. Pat. No. 6,031,193 entitled CIRCUIT BREAKER SWITCH INTERLOCK also discloses an interlock for tandemly aligned circuit breaker switches. The interlock of the '193 patent includes a substantially inflexible control member movably retained relative to the switches. Like the interlock of the '646 patent, the control members are constructed and arranged such that pushing the first operating handle from an ON to an OFF position pushes the second operating handle from an ON to an OFF position. Although the drawings of the '193 patent illustrate tandemly aligned circuit breakers, the disclosed invention contemplates an interlock for both tandemly aligned and adjacently disposed circuit breakers.

The coupled circuit breakers shown in the prior art are manually operated, requiring someone at the load panel to physically switch the circuit breakers to the desired position. For situations in which time is critical, or where the load panel is unattended, inaccessible, or otherwise unusable, the manual operation of such coupled circuit breakers constitutes a significant limitation on system capability.

Accordingly, there is a need for a coupler that can be used in combination with a circuit breaker assembly including oppositely disposed side-by-side poles to simultaneously shut down a primary power source for a circuit or load and to power that circuit from a secondary source of power. In a preferred embodiment of the invention this switching can be done remotely by incorporating a motorized circuit breaker into the circuit breaker assembly and utilizing the coupler to interconnect the primary to the secondary breakers.

SUMMARY OF THE INVENTION

It is an object of the present invention to provide oppositely disposed side-by-side, coupled circuit breakers that may be activated remotely such that when one circuit breaker switches OFF in response to a remote control signal the other automatically switches ON and vice versa.

It is a further objective to provide remotely actuated and oppositely disposed circuit breakers in a side-by-side configuration to minimize panel space, and to restrict any contact arcing egress to behind the panel thereby avoiding environmentally hazardous dielectric breakdown conditions at the front of the panel.

In accordance with the present invention, these objects are achieved in a circuit breaker assembly that includes at least two circuit breakers, of at least one pole each, arranged alongside one another but with one breaker reversed from the other breaker such that with one breaker pole OFF the other breaker pole is ON and vice versa. An interlock or coupling device connects the breaker actuator toggles in spite of the asymmetrical arrangement of the toggles characteristic of split case breakers such as described herein. A remotely operated motorized module is preferably provided in a split case breaker housing similar to the split case circuit breaker housings, and arranged alongside one or the other of these oppositely disposed circuit breakers.

DETAILED DESCRIPTION OF THE PREFERRED EMBODIMENT

Figure 1:
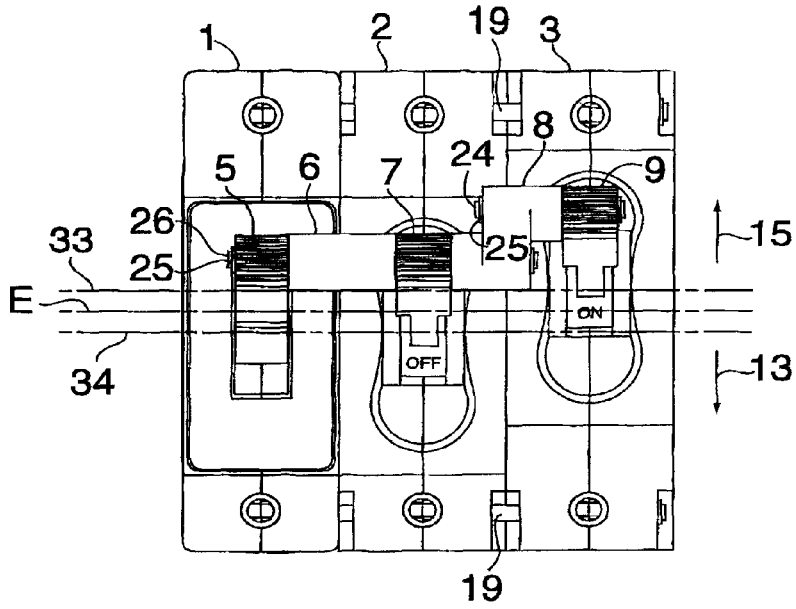
FIG. 1 is a schematic front view of an assembly, including a remotely actuated circuit breaker assembled with oppositely disposed and coupled circuit breakers of the present invention.

The preferred embodiment of the present invention is shown assembled in FIG. 1. Remote module 1, having toggle actuator 5 with conventional handle throughhole includes a split case molded circuit breaker housing having industry standard dimensions. This module 1 may be activated either remotely in response to a control signal generated by a conventional circuit, or manually using toggle actuator 5.

Host circuit breaker 2 having toggle actuator 7 with handle throughhole is mounted adjacent to remote module 1 such that toggle actuators 5 and 7 pivot about a common axis offset from central lateral plane E and handle throughholes in toggle actuator handles 7 and 5 are aligned with one another so as to be conventionally linked by tie pin 6.

Circuit breaker 3 having toggle actuator 9 with handle throughhole is mounted adjacent to but inversely oriented relative to host circuit breaker 2 such that when circuit breaker 3 is ON, host circuit breaker 2 is OFF. Toggle actuators 7 and 9 are both positioned in the same direction 13. Likewise when host circuit breaker 2 is ON and circuit breaker 3 is OFF toggle actuators are both positioned in the opposite direction 15.

As shown in FIG. 1, toggle actuators 9 and 7 pivot about substantially parallel axes disposed on opposite sides of central lateral plane E. Throughholes (not shown) in handle actuators 7 and 9 also have substantially parallel axes. As will be more fully described below, toggle actuators 5, 7 and 9 are interlocked or coupled using handle ties 6 and 8, so that remote or manual actuation of host circuit breaker 2 to the OFF position automatically causes circuit breaker 3 to switch to the ON position and vice versa.

Remote module 1 is generally similar to the "Remote Operated Circuit Breaker" described in Carlingswitch Product Bulletin #81, dated Mar. 31, 2000, incorporated herein by reference, and disclosed in detail in a co-pending patent application Ser. No. 09/710018, entitled REMOTE OPERATED CIRCUIT BREAKER MODULE, also incorporated by reference herein.

Figure 2:
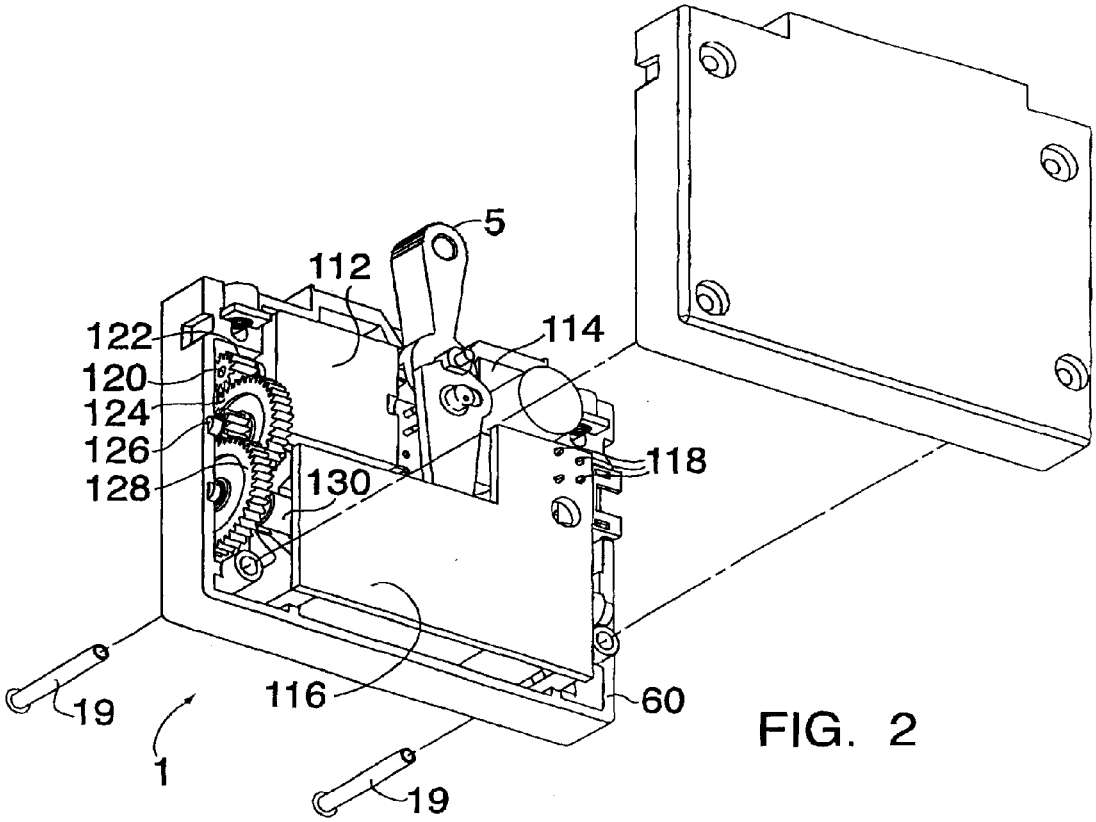
FIG. 2. is an exploded view of a remote module of the type shown in the FIG. 1 assembly.

Referring to FIG. 2, such a remote module generally includes a module toggle actuator 5 pivotally mounted to the interior of the module housing 60. A motor 112 is disposed within the module housing 60 and is electrically connected to a small printed circuit board 114. A limit switch (not shown), on the underside of the small printed circuit board 114 and electrically connected to the motor 112, is provided for controlling the direction of rotation of the motor 112. The small printed circuit board 114 is electrically connected to a large printed circuit board 116 by a plurality of pin board connectors 118. The small printed circuit board 114 and the large printed circuit board 116 together provide voltage regulation and signal conditioning to the motor 112. Input power to the motor 112 is supplied through either the electrical terminals (not shown) or wire leads (not shown) connected to the small circuit board 114. The motor 112 includes a motor shaft 120 with a motor gear 122 mounted axially thereon. The motor gear meshes with a double gear 124 which is pivotally mounted to the interior of the module housing 60 via a double gear pin 126.

The double gear 124 meshes with a lead screw gear 128 provided on a lead screw 130. Thus, motor 112 drives lead screw 130 at a reduced speed, providing a controlled force on lead screw car (not shown) to position the internally threaded lead screw car along the length of the lead screw 130. The lead screw car pivotally drives the module toggle actuator 5. At the extreme end of its intended course of travel along the lead screw, the lead screw car actuates a limit switch (not shown) to reverse the direction of the motor 112.

Circuit breakers 2 and 3 (FIG. 1) are preferably hydraulic/magnetic circuit breakers generally similar in type to that described in issued U.S. Pat. Nos. 4,347,488 entitled MULTI-POLE CIRCUIT BREAKER and 4,760,226 entitled SPLIT CASE CIRCUIT BREAKER WITH MULTI-PURPOSE WELL.

Figure 3:
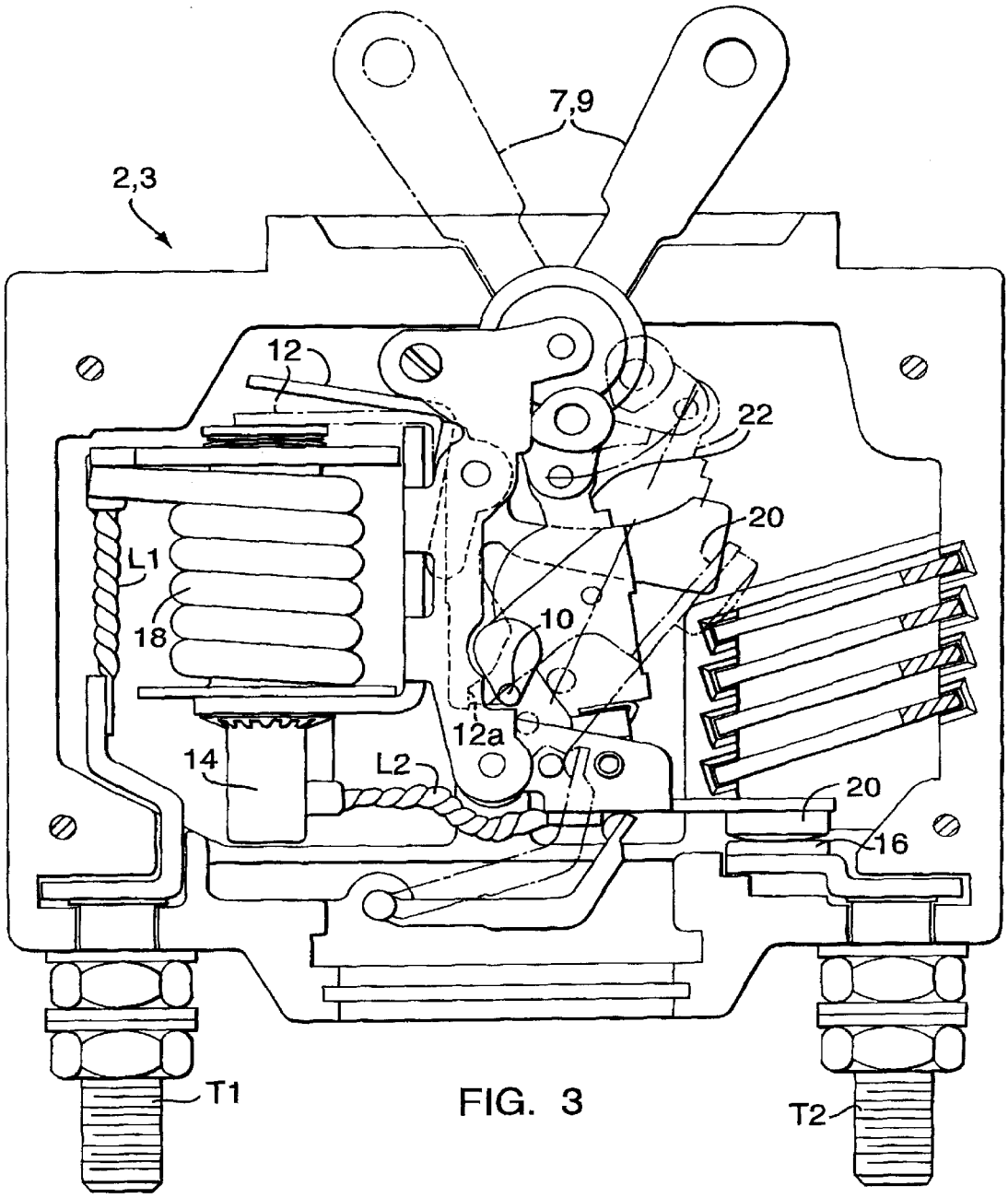
FIG. 3 is a schematic view of a circuit breaker such as those of FIGS. 1 and 2.

Referring to FIG. 3, such circuit breakers generally include a collapsible link provided between a movable contact arm and a pivotally mounted toggle actuator. The collapsible link structure is indicated schematically at 22 and as suggested by the broken line position is adapted to be operated without collapsing by the actuator handle 7,9, so as to achieve direct opening and closing movement of the movable contact arm. The circuit breaker is connected in a circuit to be protected through terminals T1 and T2. FIG. 2 illustrates terminal T1 as connected by lead L1 to an internal electromagnetic coil 18 and from the coil to the movable contact arm by lead L2. When the movable contact arm 20 is in the solid line position to achieve closing of its contact with fixed contact 16 electrical current will flow through the toggle actuator. When the current in the coil 18 exceeds a predetermined design level a magnetic circuit will be closed through a core (not shown) in element 14 drawing armature 12 downwardly causing pin means 10, to be acted upon by a leg 12*a* of the armature. The collapsible link 22 is collapsed by this action upon pin means 10. This electromagnetic tripping process causes the link 22 to collapse and the circuit breaker contacts to open. Movable contact lever 20 can also be manually moved from the closed to the open position using actuator handle 7,9.

Figure 4:
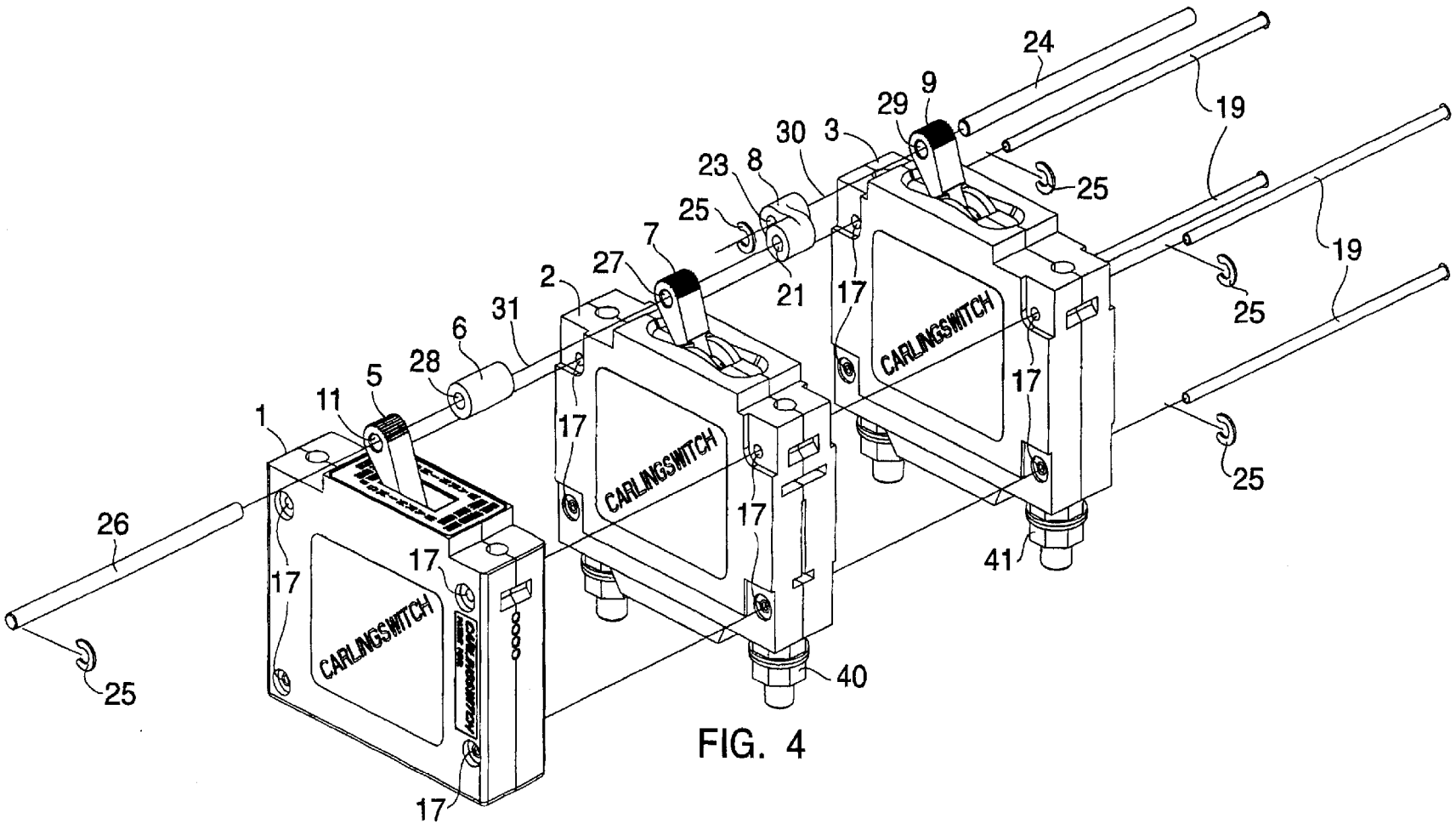
FIG. 4 is an exploded view of the remotely actuated circuit breaker assembly for oppositely disposed and coupled circuit breakers depicted in FIGS. 1–3.

A preferred embodiment of the present invention is shown in detail in FIG. 4. Remote module 1, is assembled with host circuit breaker 2 and inversely oriented circuit breaker 3, as described with reference to FIGS. 1 and 2, by rivets 19 projecting through corner throughholes 17 of circuit breakers 2 and 3 and remote module 1.

Axially aligned handle throughholes 11 and 27 define a first toggle axis 30. A second toggle axis 31, parallel to the first toggle axis 30, is defined by handle throughhole 29 as shown. Toggle actuators 7 and 9 pivot about first and second pivot axes 33 and 34 respectively which are preferably parallel and disposed on opposite sides and equidistant from central lateral plane E. First and second pivot axes 33 and 34 are also parallel to and spaced equally from first and second toggle axes 30 and 31 respectively.

An offset shaped handle tie 8 has throughbores 21 and 23 axially aligned with toggle axes 30 and 31 respectively. Pin 24 projects through handle throughhole 29 and throughbore 23 along toggle axis 31 to pivotally connect handle tie 8 at one end to toggle actuator handle 9. C-washers 25 disposed at both ends of pin 24 secure handle tie 8 to toggle actuator handle 9. The opposite end of handle tie 8 is pivotally connected to toggle actuator handle 7 using pin 26 as described below. Inversely oriented circuit breakers 2 and 3 are thus interlocked and operably linked such that when circuit breaker 2 is switched OFF, inversely oriented circuit breaker 3 is switched ON, and vice versa.

Referring still to FIG. 4, a conventional tubular shaped handle tie 6 with throughbore 28 centered on toggle axis 30 is disposed between toggle actuator handles 5 and 7. Pin 26 projects through throughholes 11 and 27 and throughbores 28 and 21 along toggle axis 30 and is secured with C-washers 25 disposed at each end. Handle tie 6, in combination with handle tie 8, thus mechanically couple or interlock toggle actuator handles 5, 7, and 9 to provide for remote actuation of oppositely coupled circuit breakers 2 and 3.

Figure 5:
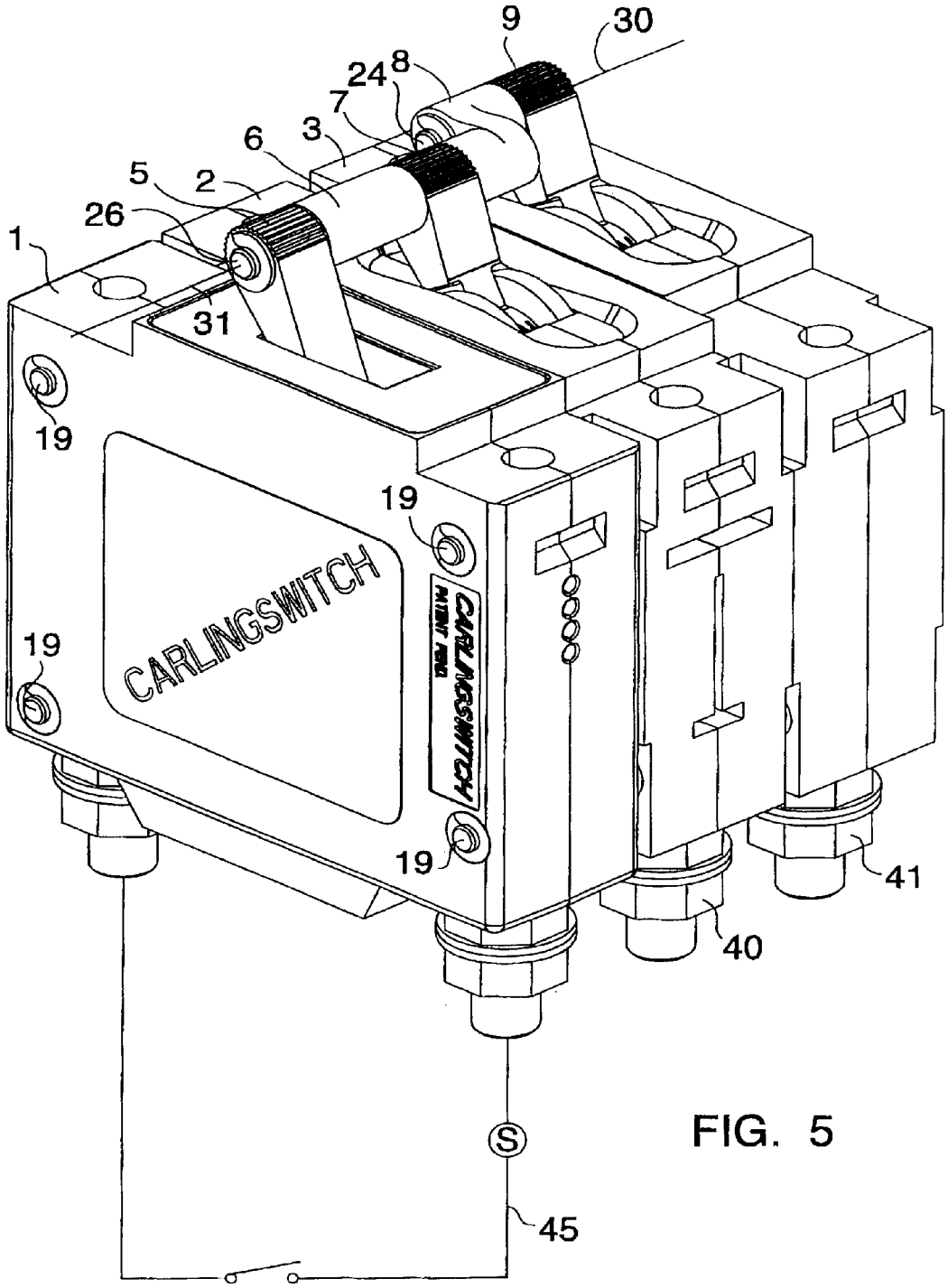
FIG. 5 is a schematic view of the present invention with an electrical control circuit for the remote module.

FIG. 5 shows the preferred embodiment of the present invention as used in a typical application. Remote module 1, host circuit breaker 2 and inversely oriented circuit breaker 3 are adjacently disposed and coupled using handle ties 6 and 8 to interlock toggle actuator handles 5, 7 and 9 as shown. Host circuit breaker 2, normally ON, has terminal 40 connected to normal load power. Inversely oriented circuit breaker 3, normally OFF, is connected to auxiliary power through terminal 41. When circuit 45 is closed by remote actuation, remote module 1 switches host circuit breaker 2 to the OFF position and inversely oriented circuit breaker 3 to the ON position. Thus only normal or auxiliary power may be connected to the load at any given time.

It will be appreciated by those skilled in the art that multiple pairs and various other combinations of oppositely disposed circuit breakers may be coupled in like manner to meet a range of system applications without departing from the spirit and scope of the invention. Accordingly, the foregoing description of the preferred embodiment is to be understood as exemplary only and not as a limitation on the scope of the invention set forth with the following claims.

I claim:

1. A circuit breaker assembly comprising:

a first circuit breaker enclosure of generally rectangular shape and having one side and an opposite side, and a toggle actuator pivotally mounted in a top or front side on an axis that is not midway between the opposed ends of the circuit breaker enclosure;

a second circuit breaker enclosure also of generally rectangular shape with opposite sides and a toggle actuator pivotally mounted in a top or front side on an axis that is disposed opposite said first circuit breaker pivot axis with respect to a central lateral plane midway between the opposed ends of both said first and second circuit breaker enclosures when said enclosures are assembled adjacent one another but in oppositely disposed relationship to one another;

a link pivotally connected at one end to said first circuit breaker toggle for movement on a first toggle axis parallel said first pivot axis of said first circuit breaker toggle, said link having an opposite end pivotally connected to said second circuit breaker toggle for movement on a second toggle axis parallel said second pivot axis of said first and second toggle axis being themselves parallel to one another and spaced equally from their respective toggle pivot axes; and wherein said circuit breaker enclosures are secured adjacent to one another by a plurality of rivets extending through openings adjacent each corner of said rectangular enclosures.

2. The circuit breaker assembly of claim 1 wherein said link comprises a unitary member having parallel throughbores axially aligned with said first and second toggle axes respectively and wherein said first and second circuit breaker toggles have a handle with distally located holes centered on said first and second toggle axes respectively.

3. The circuit breaker assembly of claim 2 further comprising a pair of pins, each of said pins extending through said aligned pair of holes and throughbores, along said first and second toggle axes, to pivotally connect the said unitary member to said first and second circuit breaker toggles.

4. The circuit breaker assembly of claim 3 wherein each of said pins is secured with C-washers disposed in annular slots adjacent opposing ends of said pin.

5. The circuit breaker assembly of claim 1, further characterized by a remotely operable motorized module also having a similar enclosure shape, and having a pivoted toggle on an axis aligned with one or another of said circuit breaker handle pivot axes, said module being shaped so as to be assembled alongside one or the other of the first and second circuit breaker assemblies, and at least one tie pin connecting the circuit breaker toggle of the one or the other circuit breaker assemblies to the toggle of said module whereby remote operation of the entire assembly is provided.

6. A circuit breaker assembly comprising:

a first circuit breaker enclosure of generally rectangular shape and having one side and an opposite side, and a toggle actuator pivotally mounted in a top or front side on an axis that is not midway between the opposed ends of the circuit breaker enclosure;

a second circuit breaker enclosure also of generally rectangular shape with opposite sides and a toggle actuator pivotally mounted in a top or front side on an axis that is disposed opposite said first circuit breaker pivot axis with respect to a central lateral plane midway between the opposed ends of both said first and second cirucit breaker enclosures when said enclosures are assembled adjacent one another but in oppositely disposed relationship to one another;

a link pivotally connected at one end to said first circuit breaker toggle for movement on a first toggle axis parallel said first pivot axis of said first circuit breaker toggle, said link having an opposite end pivotally connected to said second circuit breaker toggle for movement on a second toggle axis parallel said second pivot axis of said first and second toggle axis being themselves parallel to one another and spaced equally from their respective toggle pivot axes, said link includes a unitary member having parallel throughbores axially aligned with said first and second toggle axes respectively and wherein said first and second circuit breaker toggles have a handle with distally located hole centered on said first and second toggle axes respectively;

a pair of pins, each of said pins extending through said aligned pair of holes and throughbores, along said first and second toggle axes, to pivotally connect the said unitary member to said first and second circuit breaker toggles; and wherein each of said pins is secured with C-washers disposed in annular slots adjacent opposing ends of said pin.

* * * * *